US011518590B2

(12) United States Patent
Botdorf et al.

(10) Patent No.: US 11,518,590 B2
(45) Date of Patent: Dec. 6, 2022

(54) MULTI-PURPOSE SECURABLE TRAVEL BEVERAGE CONTAINER AND LOCKBOX

(71) Applicant: Advanced Travel Systems, Inc., Prescott, AZ (US)

(72) Inventors: John C. Botdorf, Castle Rock, CO (US); David Mudrick, Prescott, AZ (US)

(73) Assignee: ADVANCED TRAVEL SYSTEMS, INC., Prescott, AZ (US)

( * ) Notice: Subject to any disclaimer, the term of this patent is extended or adjusted under 35 U.S.C. 154(b) by 0 days.

(21) Appl. No.: 17/141,011

(22) Filed: Jan. 4, 2021

(65) Prior Publication Data

US 2021/0206552 A1 Jul. 8, 2021

Related U.S. Application Data

(60) Provisional application No. 62/957,087, filed on Jan. 3, 2020.

(51) Int. Cl.

| | |
|---|---|
| ***B65D 55/14*** | (2006.01) |
| ***B65D 77/04*** | (2006.01) |
| ***B65D 43/02*** | (2006.01) |

(52) U.S. Cl.

CPC ..... *B65D 55/145* (2013.01); *B65D 43/0231* (2013.01); *B65D 77/0486* (2013.01); *B65D 2543/00092* (2013.01)

(58) Field of Classification Search

CPC ..... B65D 55/145; B65D 77/0486; B65D 43/0231; B65D 2543/00092

USPC ..... 220/23.87

See application file for complete search history.

(56) References Cited

U.S. PATENT DOCUMENTS

| | | | | |
|---|---|---|---|---|
| 1,949,677 | A * | 3/1934 | Wllbur | B65D 81/3886 383/96 |
| 3,734,336 | A * | 5/1973 | Rankow | B65D 81/3827 220/516 |
| 5,261,554 | A * | 11/1993 | Forbes | A45C 11/20 220/592.16 |
| 5,335,809 | A * | 8/1994 | Toida | A47J 41/0011 220/23.88 |
| 5,765,712 | A * | 6/1998 | Skinner | B65D 25/04 220/501 |
| 7,866,505 | B2 * | 1/2011 | Perlman | A45C 13/18 220/835 |
| 9,616,313 | B2 * | 4/2017 | Townsend | B65D 43/0206 |
| 10,029,842 | B2 * | 7/2018 | Seiders | A45C 11/20 |
| RE47,064 | E * | 10/2018 | Normand | A45F 3/46 |
| 10,294,022 | B2 * | 5/2019 | Blazer | B65F 1/1615 |
| 2006/0241537 | A1 * | 10/2006 | Liu | A61H 15/0092 601/118 |
| 2009/0026213 | A1 * | 1/2009 | McCarthy | B65D 21/0233 220/592.2 |
| 2018/0339809 | A1 * | 11/2018 | Dinihanian, Jr. | A45C 11/24 |

* cited by examiner

*Primary Examiner* — Don M Anderson
*Assistant Examiner* — Eric C Baldrighi
(74) *Attorney, Agent, or Firm* — Berg Hill Greenleaf Ruscitti, LLP.

(57) ABSTRACT

The invention relates to a multi-purpose securable beverage container system having an integrated locking mechanism that can be used as a combination multi-beverage container, as well as a personal security device for safely storing valuable objects.

5 Claims, 10 Drawing Sheets

MULTI-PURPOSE SECURABLE TRAVEL BEVERAGE CONTAINER AND LOCKBOX

CROSS-REFERENCE TO RELATED APPLICATION

This application claims the benefit of and priority to U.S. Provisional Application No. 62/957,087 filed Jan. 3, 2020. The entire specification and figures of the above-referenced application are hereby incorporated, in their entirety by reference.

TECHNICAL FIELD

The invention relates to a securable travel container having an integrated locking mechanism that can be used as a combination beverage container, as well as a personal security device for safely storing valuable objects.

BACKGROUND OF THE INVENTION

Beverage and other containers are well known in the art. Traditional beverage containers generally include a ruggedized outer body with a securable lid for holding a beverage. Some traditional beverage containers further include thermal insulation characteristics to maintain the beverage at a certain temperature. However, such traditional beverage containers are generally limited in functionality and their ability to include additional value-added features. Being generally small so as to facilitate easy transport by a consumer, traditional beverage containers are easily stolen or lost.

Another issue that arises with many travelers is the ability to secure valuable objects at locations that lack the infrastructure to secure small objects, such as a wallet, passport, or cell phone. For example, popular locations such as beaches and swimming pools, as well as other outdoor or wilderness locations often do not have suitable locations to secure valuable personal objects. Oftentimes, such object must be left in a car or hotel room, which can also leave them vulnerable to theft.

As such, there exists a need for an improved securable travel container that addresses the problems identified above. Namely, an improved securable travel container that maintains the functionality of a beverage container, while also providing a novel securement device to protect valuable personal items in a variety of locations. This securable travel container must further be both practical and cost effective. Importantly, the system must employ non-traditional systems and configurations to provide multiple layers of protection, from integrated locking mechanisms, to multi-layer reinforcing vessels and outer shell configurations, as well as variable-length cord-based securement mechanisms that allows the container to be secured in a variety locations.

SUMMARY OF THE INVENTION

In one aspect the invention relates to a securable beverage container system having an integrated locking mechanism that can be used as a combination multi-beverage container, as well as a personal security device for safely storing valuable objects.

Another aspect of the invention relates to a multi-purpose securable beverage container having a plurality of nested containers that can, for example include a beverage container, a martini shaker, a coffee mug, a cocktail receptacle, or wine receptacle.

Another aspect of the invention relates to a securable travel container having an integrated locking mechanism that can be used as a combination beverage container and personal security device for safely storing valuable or other important objects.

Another aspect of the invention relates to a securable container having an integrated locking mechanism comprising a locking cable coupled with a securable cover having collar configured to be coupled with an integrated locking mechanism on the outer shell of the container, wherein said integrated locking mechanism further comprises: (i) a lock positioned on the outer shell of the container and configured to received and secure the collar of said locking cable; (ii) coupler position on the securable cover aligned with the lock forming a collar aperture configured to allow the collar of the locking cable to be inserted into the lock; and (iii) a release configured to release the collar. In one embodiment, the lock may be a combination lock that can be customized by a user.

Additional aspects of the invention may become apparent from the specification, drawings, and claims provided below.

BRIEF DESCRIPTION OF THE FIGURES

The novel aspects, features, and advantages of the present disclosure will be better understood from the following detailed descriptions taken in conjunction with the accompanying figures, all of which are given by way of illustration only, and are not limiting the presently disclosed embodiments, in which.

DETAILED DESCRIPTION OF THE INVENTION

The present invention includes a variety of aspects, which may be combined in different ways. The following descriptions are provided to list elements and describe some of the embodiments of the present invention. These elements are listed with initial embodiments; however, it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1:
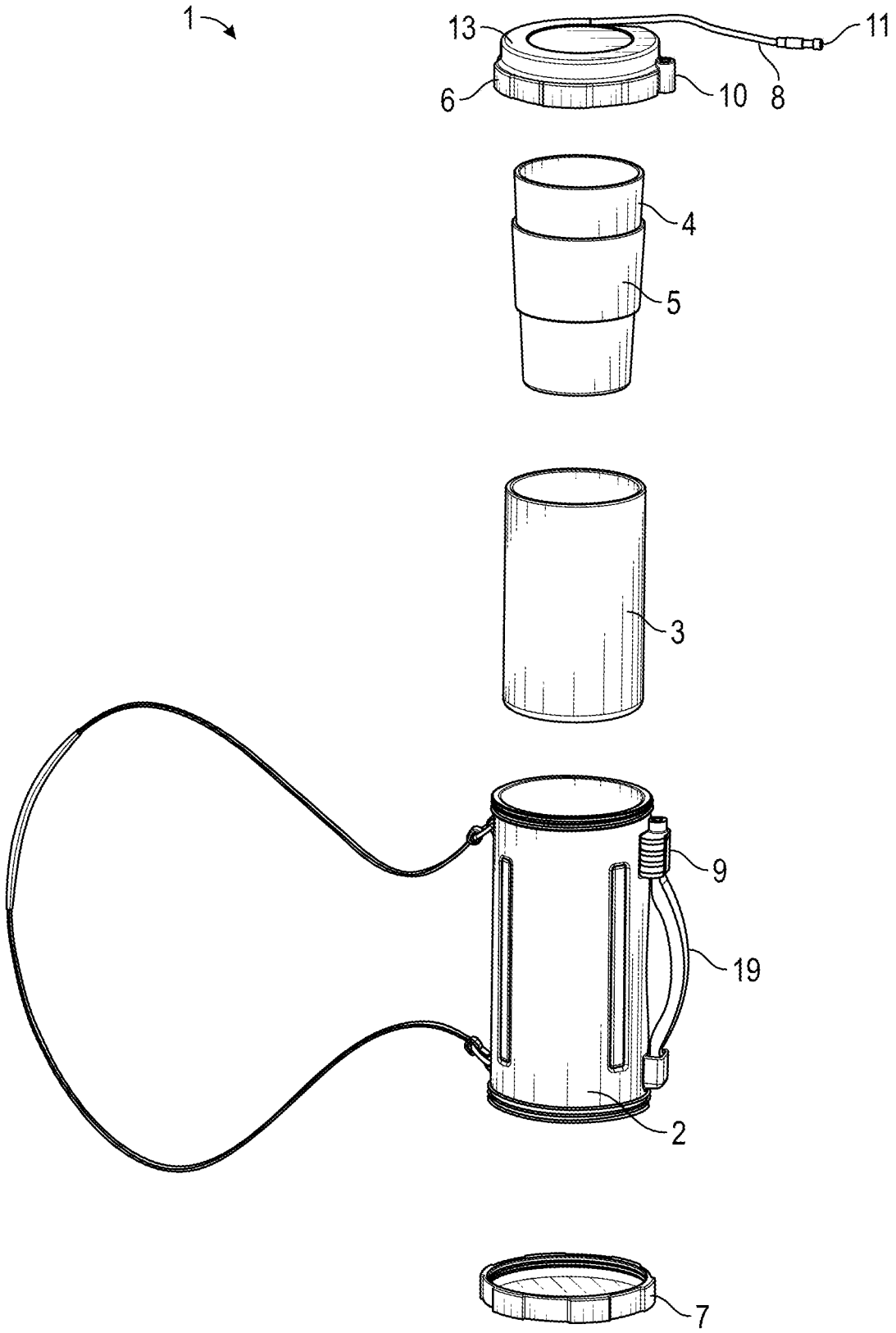
FIG. 1: is an exploded view of the modular components of a securable travel container in one embodiment thereof.
Figure 2:
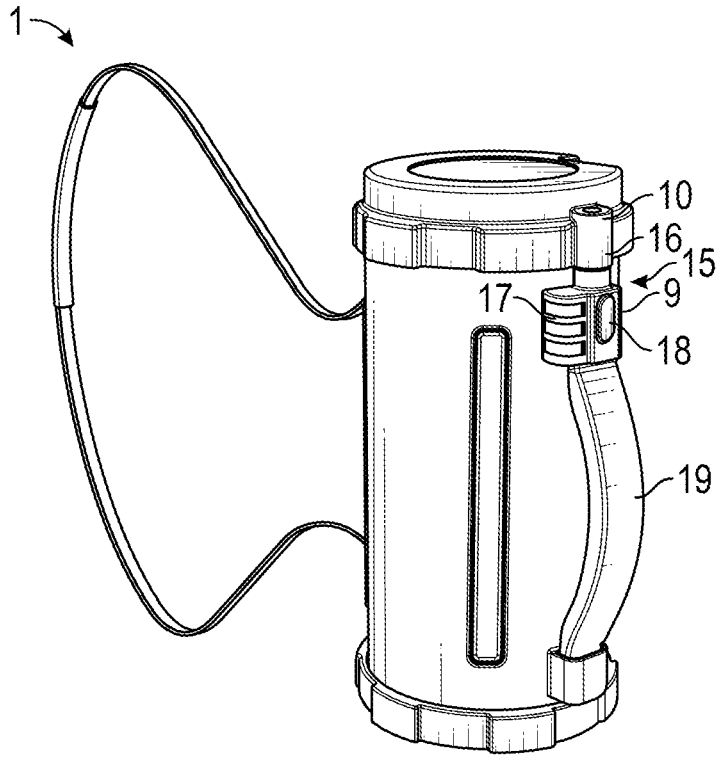
FIG. 2: is a back perspective view of a securable travel container having an integrated locking mechanism in one embodiment thereof.
Figure 3:
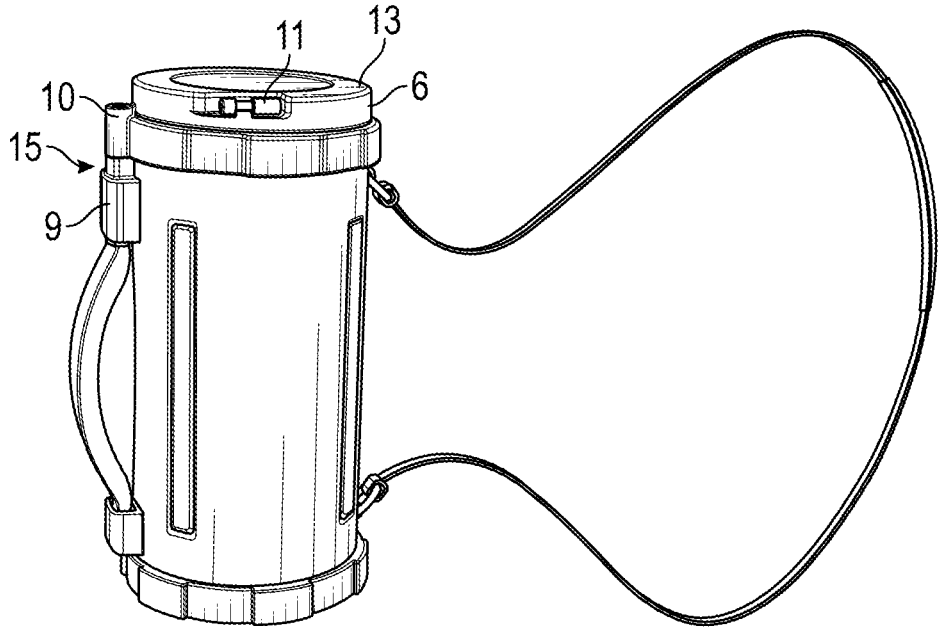
FIG. 3: is a back perspective view of a securable travel container having locking cable positioned within a cable channel of a securable cover in one embodiment thereof.
Figure 4B:
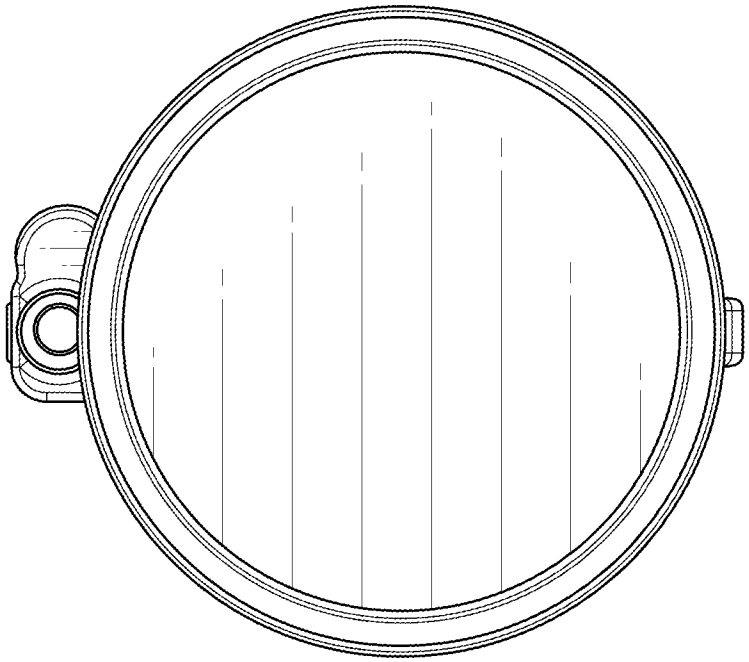
FIG. 4: is a front and back view of the reinforced outer shell having an integrally positioned lock and release component in one embodiment thereof.
Figure 4A:
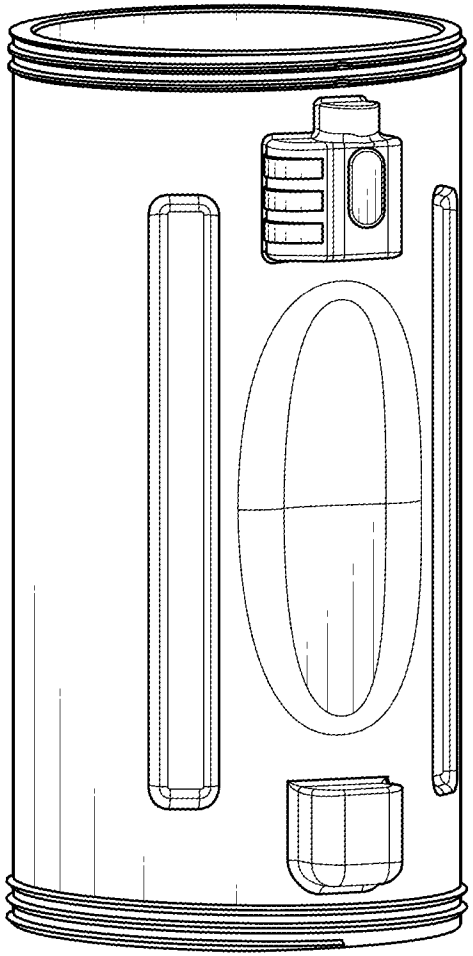
Figure 4E:
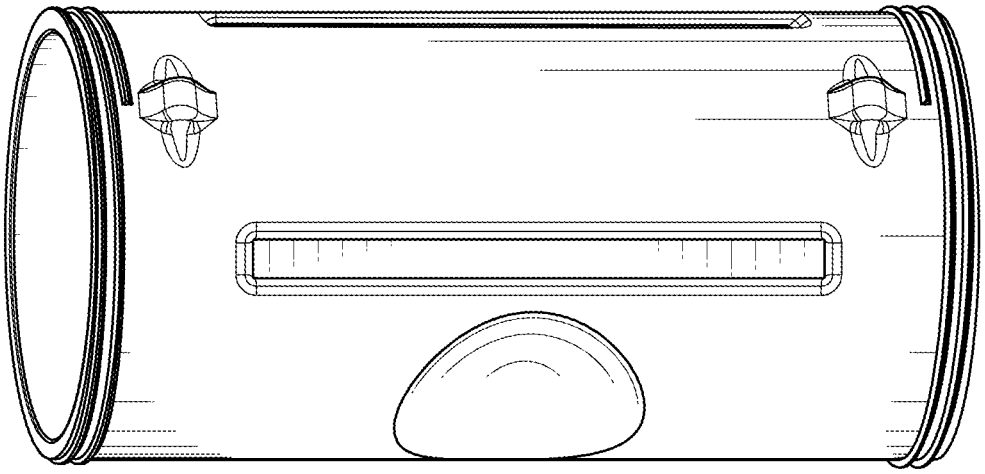
Figure 4D:
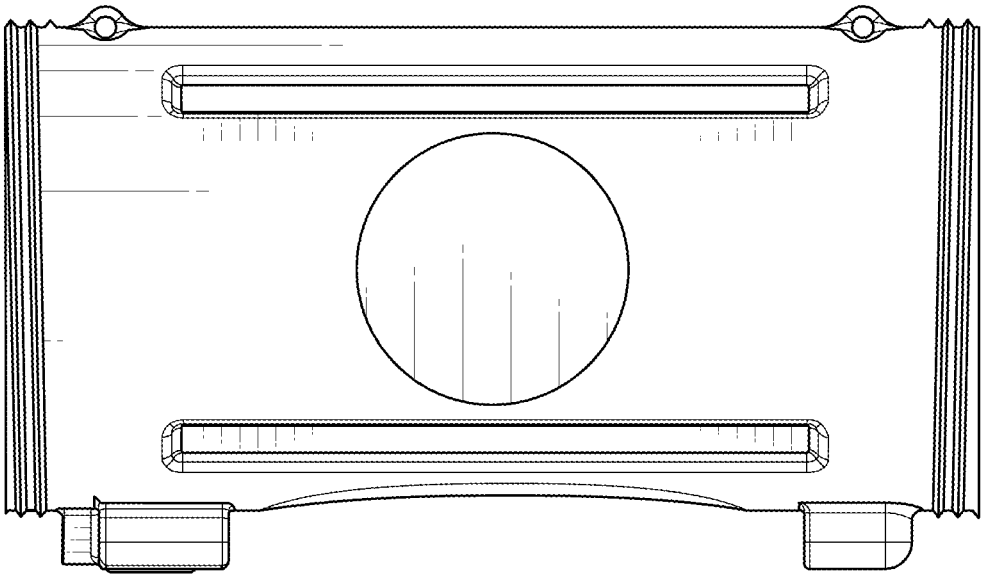
Figure 4C:
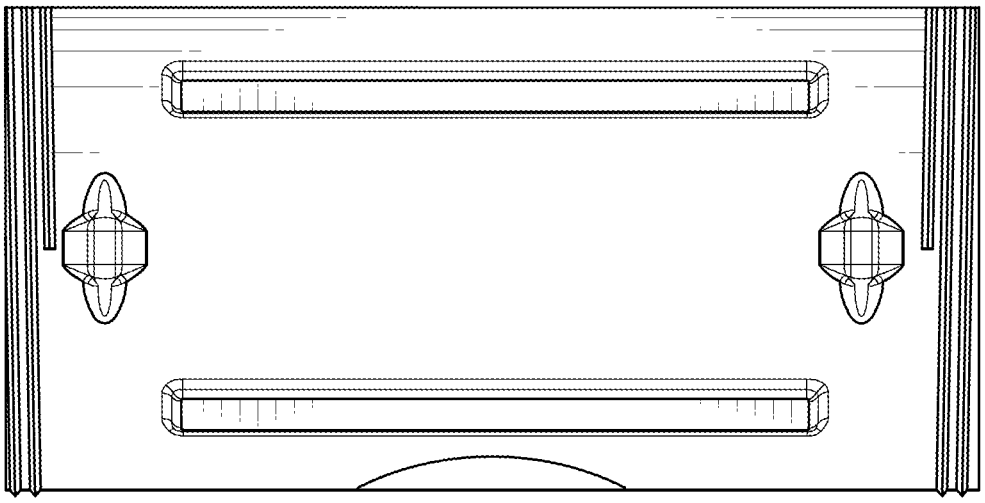

The inventive technology may include a securable travel container (1). Generally referring to FIG. 1, in one preferred embodiment a securable travel container (1) may include an outer shell (2) which may further be formed from a ruggedized material, such as hard plastic, metal, or other like compositions. The outer shell (2) may further be configured to secure one or more secondary components. For example, as shown in FIGS. 2-3, the outer shell (2) may include a plurality of anchor positions to secure attachments, such as a carrying strap (21), or a handle (19). As noted above, the outer shell (2) may be formed as a unitary component, for example through injection molding or other similar manufacturing processes known in the art.

The outer shell (2) may also be configured to secure an end cap (7) at one of its terminal ends. Referring to FIG. 1, in this embodiment the outer shell (2) may be formed to include a threaded position that may be mated with a corresponding threaded position on a matching end cap (7).

Figure 5B:
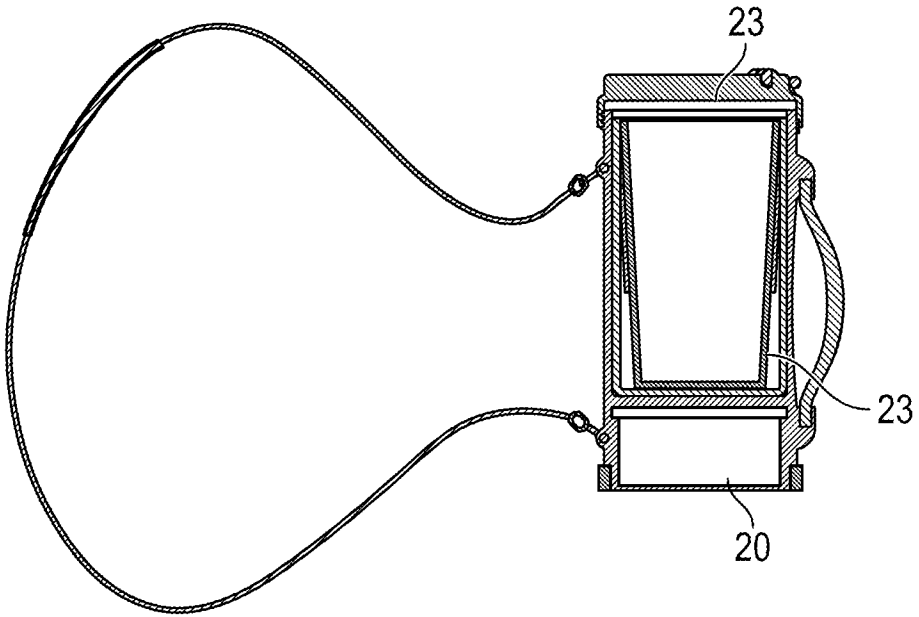
FIG. 5: is a cross section view of a securable travel container having a secondary compartment at its terminal end in one embodiment thereof, as well as an exemplary carrying strap in one embodiment thereof.
Figure 5A:
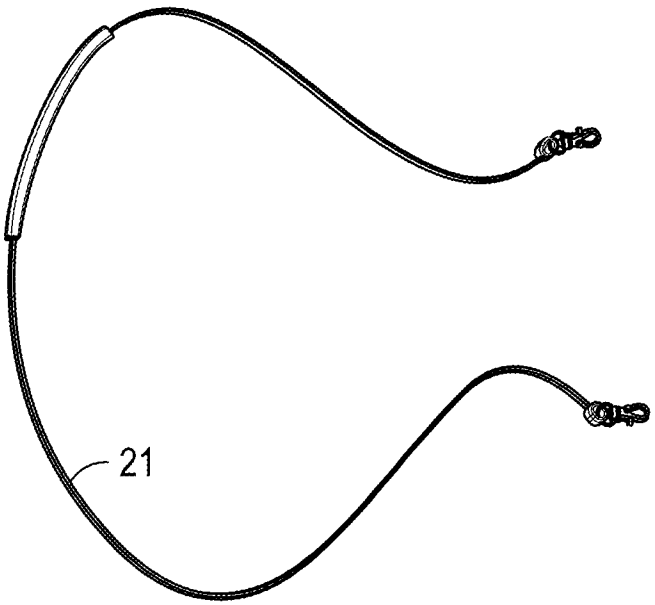
Figure 6A:
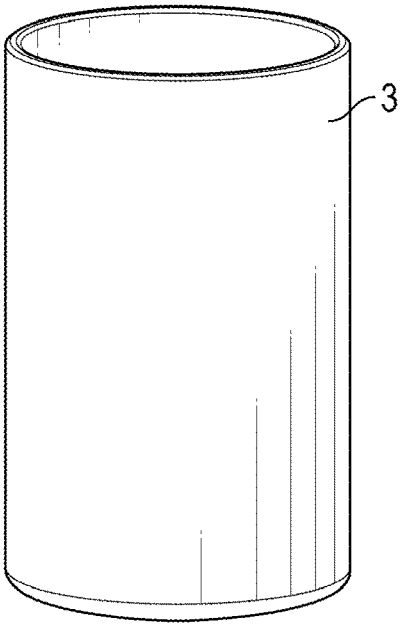
FIG. 6: is a front perspective view of an inner receptacle of a securable travel container in one embodiment thereof.
Figure 6B:
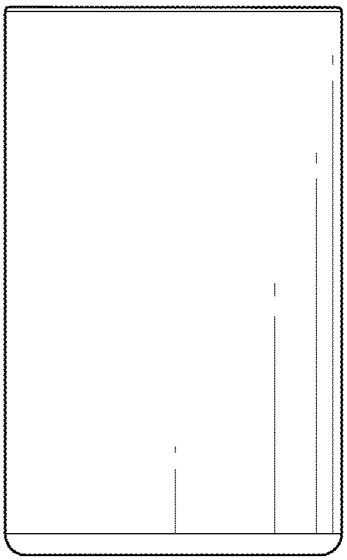
Figure 6C:
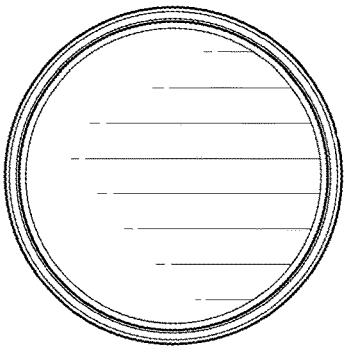
Figure 6D:
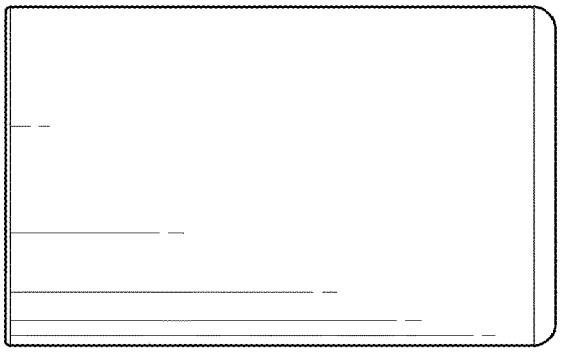
Figure 7A:
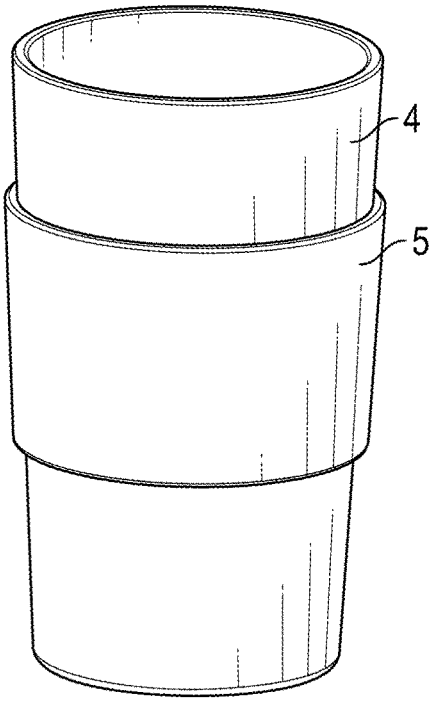
FIG. 7: is a front perspective view of a vessel coupled with a vessel support of a securable travel container in one embodiment thereof.
Figure 7B:
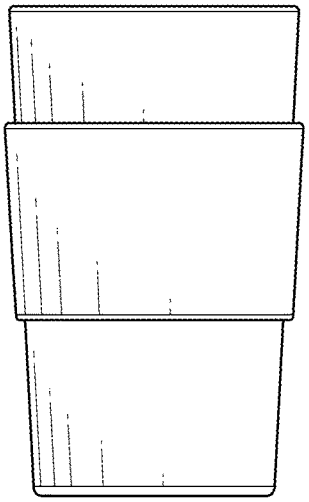
Figure 7C:
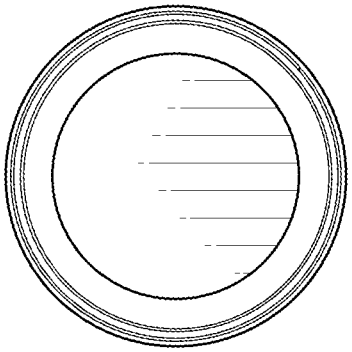
Figure 7D:
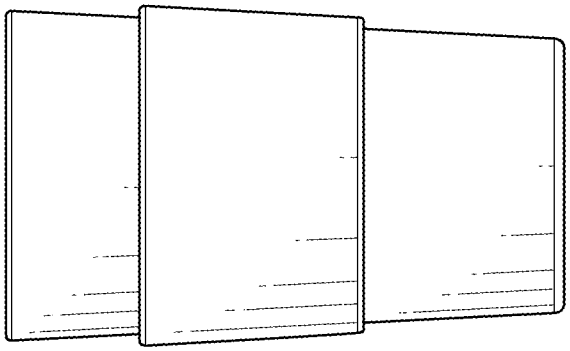
Figure 8A:
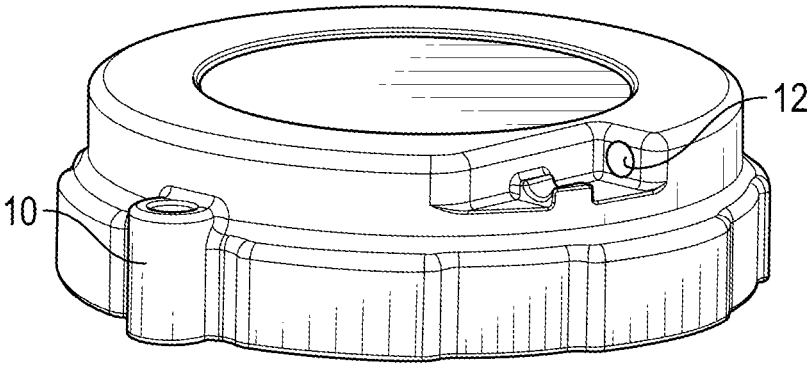
FIG. 8: is a front perspective view of an end cap having a coupler position, an integral cable aperture and an internally positioned cable channel in one embodiment thereof.
Figure 8B:
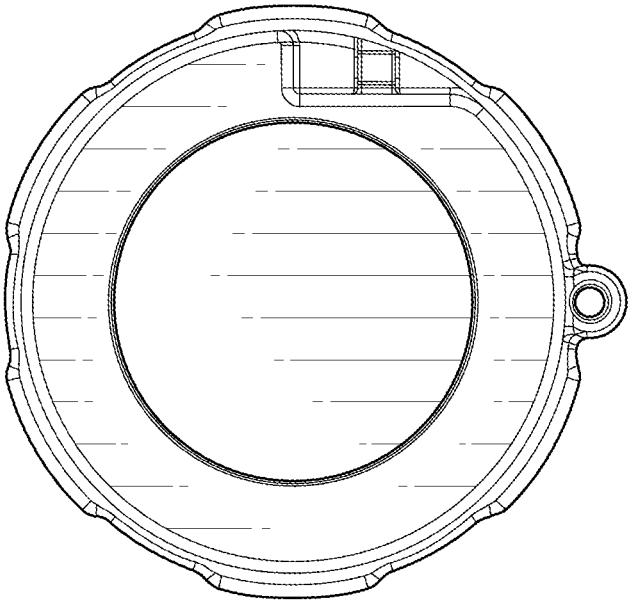
Figure 8C:
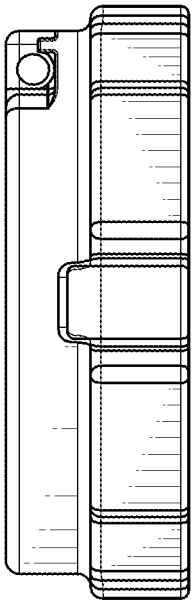
Figure 8D:
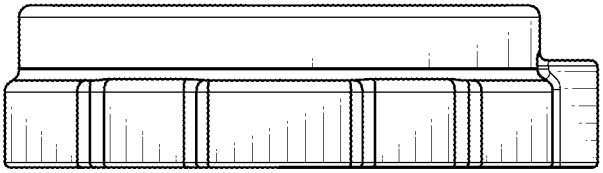

Referring now to FIG. 5, in this embodiment the outer shell (2) may include an internally positioned secondary compartment (20) that may be secured by the end cap (7). In this configuration, one or more personal items may be positioned within the secondary compartment (20) and secured by the positioning of the end cap (7). Notably, in this configuration the internal threaded positions of the outer shell (2) and end cap (7) may be hidden such that the secondary compartment (20) may not be readily apparent to an observer. In alternative embodiments, the end cap (7) may be secured to the outer shell (2) with a lock (9), such as a combination lock as generally described herein.

Additional embodiments may include a variety of different mechanisms and configurations to secure the end cap (7) to the outer shell (2). For example, in certain embodiments the end cap (7) may be secured to the outer shell (2) through one or more couplers, such as a quick release coupler, a slide coupler, a snap coupler and the like. Additionally, in certain embodiments the end cap (7) may be secured to the outer shell (2) through one or more locks that may be configured to secure the end cap (7) to the outer shell (2) forming a secure secondary compartment (20) as detailed above.

The securable travel container (1) of the invention may optionally include one or more inner receptacles (3). Referring again to FIG. 1, in this embodiment an inner receptacle (3) may be internally positioned within the outer shell (2). This inner receptacle (3) may be fitted to match the internal profile of the outer shell (2), and may further be formed from a ruggedized material, such as metal, or a hard plastic. In certain embodiments, an inner receptacle (3) may also be formed by, or coupled with, a thermal insulating material that may provide the securable travel container (1) enhanced thermal insulation capabilities. Additionally, the inner receptacle (3) may be removed and be used as a separate container for beverages and the like.

The securable travel container (1) of the invention may also include a beverage vessel (4) that may be configured to be positioned within the outer shell (2), or as shown in FIG. 1, nested within an inner receptacle (3). In this preferred embodiment, the beverage vessel (4) may be formed of a metal, and preferably stainless steel. The beverage vessel (4) of the invention may further include a vessel support (5), which may be formed of a rubber, neoprene or other like material. In this preferred embodiment, the vessel support (5) may help secure the beverage vessel (4) within the outer shell (2), or as shown in FIG. 1, nested within an inner receptacle (3). It may also provide a hand-support and thermal barrier if the beverage vessel (4) is removed and holding a hot liquid.

The securable travel container (1) of the invention may also include an integrated locking mechanism (15). In one preferred embodiment a securable cover (6) may be configured to be coupled with the outer shell (2) through the operation of an integrated locking mechanism (15). In one preferred embodiment, an integrated locking mechanism (15) may include a locking cable (8) configured to lock a securable cover (6) to, in this embodiment, the outer shell (2) forming a secure internal space where one or more small personal objects, such as a wallet, keys, or a passport may be safely stored. In this embodiment, the locking cable (8) may be a metal cable that may further be coated with, for example a thermoplastic, rubber, or other similar covering.

In the preferred embodiment shown in FIGS. 1-2, an integrated locking mechanism (15) may include a retractable locking cable (8) positioned within an internally positioned cable channel (13) on the securable cover (6). The locking cable (8) may be secured to the securable cover (6) and may further extend outward from the securable cover (6) through a cable aperture (12). In this embodiment, the locking cable (8) may be manually extended or retracted from the securable cover (6) while remaining firmly anchored to the securable cover (6). The internally positioned cable channel (13), in one optional embodiment, may be responsive to a coiling mechanism (14), that may rotationally adjust the internally positioned cable channel (13) such that the locking cable (8) is wound within the cable channel (13), for example when not in use.

Referring now specifically to FIG. 2, in one embodiment a securable cover (6) may include at least one coupler position (10) that may be configured to be coupled with a corresponding lock (9) on the outer shell (2). In this embodiment, the securable cover (6) may be attached to the outer shell (2), for example through a paired threaded coupling, or other similar coupling devices. Again, referring to the preferred embodiment shown in the figures, the coupler position (10) on the securable cover (6) may be brought into alignment with a corresponding lock (9) on the outer shell (2). In this configuration, the coupler position (10) and lock (9) form a collar aperture (16) that may be configured to secure a collar (11) secured to a locking cable (8).

In this preferred embodiment, the collar (11) of a locking cable may be inserted into the collar aperture (16) formed by the coupler position (10) on the securable cover (6) being brought into alignment with a corresponding lock (9) on the outer shell (2) forming an integrated locking mechanism (15). As shown in FIG. 1, in one preferred embodiment, the locking mechanism, shown here as a combination lock (17), may be engaged to secure the collar (11) of the locking cable (8) into a locked configuration. As also shown in FIGS. 1 and 2, the lock (9) of the outer shell (2) may have a release (18) that may assist in securing and disengaging the collar from the integrated locking mechanism (15), for example through a spring-based tension engagement interface with the collar (11). When used in conjunction with the other elements of the invention, the integrated locking mechanism (15) may allow a user to secure the locking cable (8) around, or to a stationary, or other large object such as a fence, pole, or chair, and secure the end cap (7) to the outer shell (2) forming a secured, and locked inner compartment that may hold one or more valuable personal items.

In another embodiment, a collar (11) may be secured to an alternative position. For example, in one embodiment, a second cable may be coupled with one or more components of the device and be securable with the collar (11). In a preferred embodiment, a second cable (8) may be positioned within a securable cover (6), the outer shell (2) or the end cap (7) as generally described above and may, at its terminal end have a second lock that may be coupled with the collar of the first locking cable (8). The second lock may include a combination lock, or other mechanical lock. In this preferred embodiment, the collar (11) of the first cable may be positioned around a stationary object, such as a pole, desk, or other object such as a chair or table and secured with the lock on the second locking cable thereby securing the device to the object. The locking cable(s) (8) of the invention may be variably in length and size, however, in one preferred embodiment the locking cable(s) (8) of the invention may be between 3-28 inches, and more preferably 14 inches.

Figure 9:
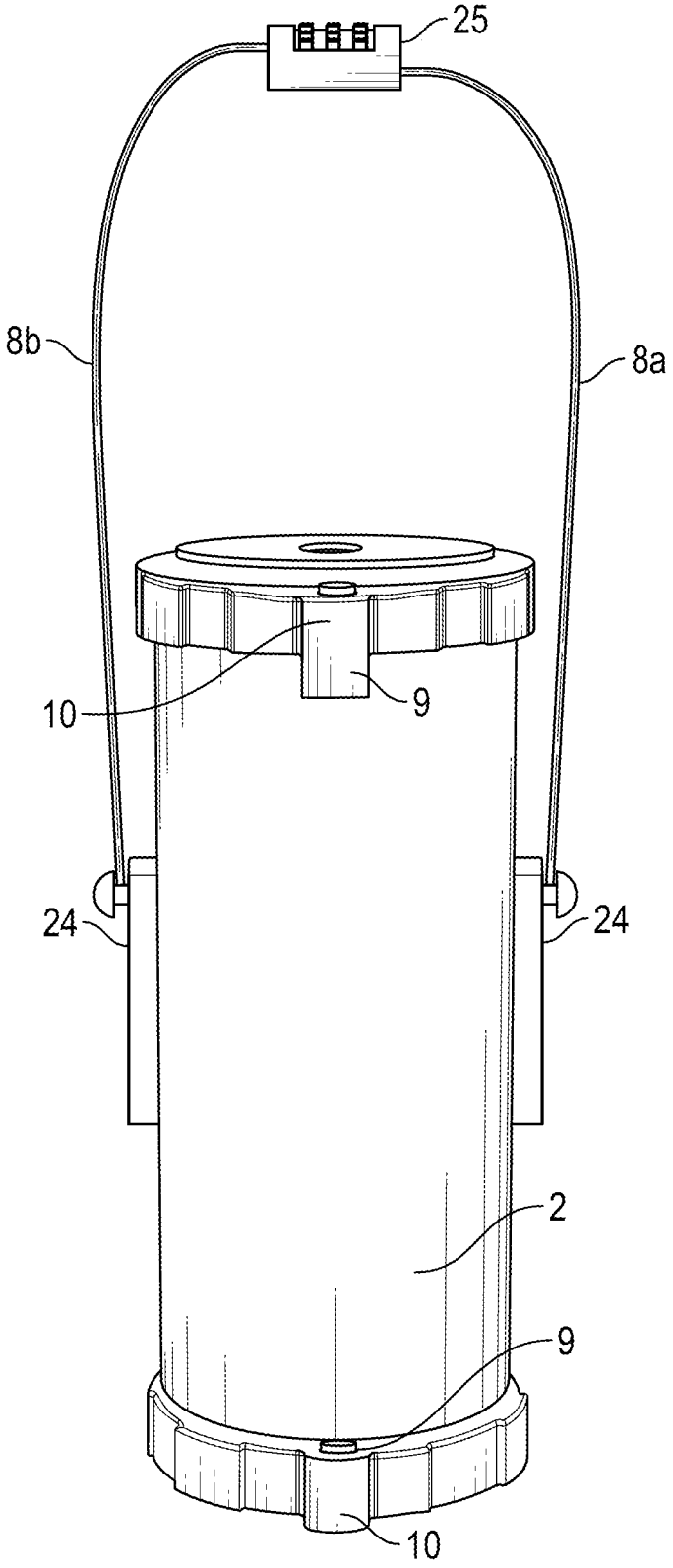
FIG. 9: is a front perspective view of an alternative embodiment of a multi-purpose securable travel container having a first and second locking cable coupled by a second lock, as well as a lock securing the securable lid to the outer shell of the device in one embodiment thereof.

Generally referring to FIG. 9, in a lock (9), in an alternative embodiment may operate independently of a locking cable (8) to secure a securable cover (6) to the outer shell (2). In this preferred alternative embodiment, a lock (9) may engage the securable cover (6) directly, for example through coupler position (10), or another securable extension, such as a second collar coupled with the securable cover (6) thereby locking the securable cover (6) to the outer shell (2).

As shown in FIG. 9 again, in an alternative embodiment a first and second locking cable (8*a*, 8*b*) may be secured to the outer shell (2) by one or more cable anchors (24). As noted above, the first and second locking cables (8*a*, 8*b*) may be coupled together and secured, for example through a cable lock (25). The cable lock (25) lock may include a combination lock, or other mechanical lock. In this preferred embodiment, the first and second locking cables (8*a*, 8*b*) may be positioned around a stationary object, such as a pole, desk, or other object such as a chair or table and secured with the lock on the second locking cable thereby securing the device to the object. The locking cable(s) (8) of the invention may be variably in length and size, however, in one preferred embodiment the locking cable(s) (8) of the invention may be between 3-28 inches, and more preferably 14 inches.

In alternative embodiments, and inner receptacle (3) and vessel (4) components may further include internal lids (not shown) that may be secured, for example through a fitted, or twist coupler and the like. In this manner, the invention provided a plurality of independently usable and mated containers that can be used for different beverages and the like. In still further embodiment of the invention, the securable cover (6), as well as the internal lids (not shown) may include a spiked surface (23) having one or more extensions. In this embodiment, ice may be positioned within an inner receptacle (3) and vessel (4), or even the outer shell (2) such that when shaken, for example when preparing a mixed drink, the ice is more easily broken up. In alternative embodiment, the inner receptacle (3) and vessel (4) may further include a spiked surface (23) having one or more extensions, In this embodiment, ice may be positioned within an inner receptacle (3) and vessel (4), such that when shaken, for example when preparing a mixed drink, the ice is more easily broken up.

Naturally, all embodiments discussed herein are merely illustrative and should not be construed to limit the scope of the inventive technology consistent with the broader inventive principles disclosed. As may be easily understood from the foregoing, the basic concepts of the present inventive technology may be embodied in a variety of ways. It generally involves apparatus, systems, methods, and techniques as well as devices to accomplish a securable travel container having, in a preferred embodiment an integrated locking mechanism. In this application, the improved techniques, including novel and unique methods and apparatus for a securable travel container and the like are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the inventive technology and may not explicitly show how each feature or element can actually be representative of a broader function or of a great variety of alternative or equivalent elements. Again, these are implicitly included in this disclosure. Where the inventive technology is described in device-oriented terminology, each element of the device implicitly performs a function. Apparatus claims may not only be included for the device described, but also method or process claims may be included to address the functions the inventive technology and each element performs. Neither the description nor the terminology is intended to limit the scope of the claims that will be included in any subsequent patent application.

It should also be understood that a variety of changes may be made without departing from the essence of the inventive technology. Such changes are also implicitly included in the description. They still fall within the scope of this inventive technology. A broad disclosure encompassing the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the inventive technology both independently and as an overall system.

Further, each of the various elements of the inventive technology and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the inventive technology, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this inventive technology is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupling method and/or technique, and or device." Such changes and alternative terms are to be understood to be explicitly included in the description.

Thus, the applicant(s) should be understood to have support to claim and make a statement of invention to at least: i) each of the methods, improvements and/or devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim* v. *Cannon Avent Group*, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like.

Finally, any claims set forth at any time are hereby incorporated by reference as part of this description of the inventive technology, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A multi-purpose securable beverage container system comprising:

an outer shell having at least one secondary compartment;

an inner receptacle positioned within said outer shell;

vessel positioned within said inner receptacle;

a securable cover configured to be coupled with said outer shell;

a metal locking cable coupled with said securable cover having a collar configured to be coupled with an integrated locking mechanism on said outer shell, wherein said integrated locking mechanism further comprises:

a lock positioned on said outer shell and configured to receive and secure said collar of said metal locking cable;

a coupler on said securable cover aligned with said lock forming a collar aperture configured to allow said collar of said metal locking cable to be inserted into said lock, and wherein said securable cover includes a cable aperture and internally positioned cable channel configured to house said metal locking cable internally within said securable cover; and a release configured to release said collar;

an end cap positioned over the secondary compartment; and a coiling mechanism positioned within said securable cover and configured to retract said flexible metal locking cable into said internally positioned cable channel.

2. The system of claim 1, and further comprising a vessel support positioned around said vessel.

3. The system of claim 1, wherein said lock comprises a combination lock.

4. The system of claim 1, wherein said end cap is secured with said outer shell with a lock.

5. The system of claim 1, and further comprising a spike surface on at least one of:

an inner surface of said securable container;

a bottom surface of said outer shell; and a bottom surface of said inner receptacle and/or said vessel.

* * * * *